US006295911B1

(12) United States Patent
Woodall et al.

(10) Patent No.: US 6,295,911 B1
(45) Date of Patent: Oct. 2, 2001

(54) ENERGY DAMPER AND RECOIL LIMITING SYSTEM FOR LINE CHARGE

(75) Inventors: Robert Woodall, Lynn Haven; Felipe Garcia, Panama City; Gilberto Irizarry, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/146,918

(22) Filed: Aug. 31, 1998

Related U.S. Application Data

(63) Continuation-in-part of application No. 09/012,932, filed on Jan. 24, 1998, now Pat. No. 6,205,903, and a continuation-in-part of application No. 09/030,518, filed on Feb. 23, 1998, now abandoned, and a continuation-in-part of application No. 09/034,772, filed on Mar. 2, 1998, now Pat. No. 5,959,233, and a continuation-in-part of application No. 08/944,049, filed on Sep. 12, 1997, now Pat. No. 5,932,835.

(51) Int. Cl.[7] ..... F41H 11/12
(52) U.S. Cl. ..... 89/1.13; 89/1.34; 102/504
(58) Field of Search ..... 89/1.13, 1.34; 244/3.12; 102/504

(56) References Cited

U.S. PATENT DOCUMENTS 3,807,671 * 4/1974 Stencel ..... 244/138 R
5,174,384 * 12/1992 Herman ..... 102/504
5,685,560 * 11/1997 Sugiyama et al. ..... 280/731

* cited by examiner

*Primary Examiner*—Stephen M. Johnson
(74) *Attorney, Agent, or Firm*—Harvey A. Gilbert; Donald G. Peck

(57) ABSTRACT

A break line launch energy damper and recoil limiting system for line charges absorbs and dissipates launch energy over time during deployment of line charges. This system limits the amount of recoil energy that can act upon the line charge and allows for linear deployment without recoil that might hinder the effectiveness of the rear lengths of the line charge. An elongate strength member connects the line charge to an inertial drag, such as a parachute and/or container for the line charge. A plurality of lines having different tensile strengths are appropriately connected to sequentially part when their tensile strengths are exceeded to thereby absorb and dissipate energy during deployment of the line charge.

8 Claims, 2 Drawing Sheets

ENERGY DAMPER AND RECOIL LIMITING SYSTEM FOR LINE CHARGE

CROSS REFERENCE TO RELATED APPLICATIONS

This is a continuation in part of U.S. patent applications entitled "Reliable and Effective Line Charge System" by Felipe Garcia et al., U.S. Patent and Trademark Office Ser. No. 09/012,932 (NC 78,433), filed Jan. 24, 1998, now U.S. Pat. No. 6,205,903; "Line Charge Insensitive Munition Warhead" by Felipe Garcia et al., U.S. Patent and Trademark Office Ser. No. 08/944,049 (NC 78,448), filed Sept. 12, 1997, now U.S. Pat. No. 5,932,835; "Line Charge Connector" by Felipe Garcia et al., U.S. Patent and Trademark Office Ser. No. 09/030,518 (NC 78,635), filed Feb. 23, 1998, now abandoned; and "Line Charge Fastener and Detonating Cord Guide" by Felipe Garcia et al., U.S. Patent and Trademark Office Ser. No. 09/034772 (NC 78,878), filed Mar. 2, 1998, now U.S. Pat. No. 5,959,233 and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to munitions deployed in line charges. In particular, this invention relates to a partially frangible link at one end of a line charge that limits recoil during deployment to assure linear deployment of the line charge without hindering the effectiveness of its rear lengths.

The use of line charge systems by the military to breach holes in mine and obstacle fields is well known. Usually, these systems are launched by rocket and deploy out of a box. The rocket pulls a line charge out of a container to fly downrange and drape over obstacles and mines. The line charge has a detonating cord, or other explosives butted end to end, and warheads that are surrounded by one or more strength members. The rocket is connected to the strength member and picks up and deploys the line charge downrange in a snake-like fashion. Upon landing, the line charge drapes over obstacles and mines. A short time later a fuze in the system detonates the explosives in the line charge to clear a path.

On deployment, for maximum effectiveness, the line charge should be pulled taut to lay out in full length. To achieve this end, line charges are connected to either parachutes, the launch container, or both. In the case of parachutes, if a tail wind is blowing during deployment, the rear of the line charge will move forward and loop past forward sections of the line charge in what is known as the "J" effect. In cases where the line charge is anchored to the container, the deployed line charge may have sufficient energy to recoil and spring forward. This may lift and move the entire container to such a degree that it will "J" forward and hence reduce its effective length. In line charges, where both containers and parachutes are used, the "J" effect is observed.

This "J" effect, is caused by excessive inertial energy being imparted to the rear of the line charge and results in looping of the explosive line in the line charge. When it is detonated, fratricide is likely to result.

Fratricide is defined as the condition whereby during the propagation of detonation along a length of the line charge, the detonation of the first elements of the line charge cuts the explosive train further along the length of line charge. This occurs prior to the arrival of the detonation front and stops the line charge from fully functioning along its entire length.

Consequently, the remaining section of line charge becomes a dud and leaves unsafe explosive elements within the path which was to have been cleared. This creation of sections of duds and the "J" effect always leaves areas within a mine and obstacle field uncleared and unsafe for transit.

Thus, in accordance with this inventive concept, a need has been recognized in the state of the art for reduction of recoil and the "J" effect associated with line charge deployment by dissipating the excessive inertia of the line charge during launch before movement by attached parachutes and/or containers.

SUMMARY OF THE INVENTION

The present invention is directed to providing a damper system for a line charge. An elongate strength member connects the line charge to an inertial drag. A plurality of lines having different tensile strengths sequentially part when their tensile strengths are exceeded to absorb and dissipate energy during deployment of the line charge.

An object of the invention is to provide an energy damper to limit the recoil associated with line charge launches to eliminate the "J" effect.

Another object of the invention is to provide an energy damper to dissipate launch energy and limit the recoil of line charges during launch.

Another object of the invention is to provide a damper to increase the effective length of a deployed line charge.

Another object of the invention is to provide an energy damper used in series or in parallel with more dampers.

Another object of the invention is to provide an energy damper using fibrous materials to absorb launch energy.

Another object of the invention is to provide an energy damper that may be made as large as necessary to accommodate the amount of energy that needs to be dissipated and absorbed as determined by the size of the line charge and the excess energy imparted by rocket or mortar.

Another object of the invention is to provide an energy damper having different energy absorption and dissipation rates by configuring the system with break lines of various strengths, sizes, and material properties.

Another object of the invention is to provide an energy damper having any number of given lengths or diameters and fabricated from numerous materials including nylon.

Another object of the invention is to provide an energy damper for absorbing and dissipating launch energy over time during deployment of line charges.

Another object of the invention is to provide a damper limiting the amount of recoil energy that can act upon the line charge and allowing for linear deployment without recoil that hinders the effectiveness of the rear lengths of the line charge.

These and other objects of the invention will become more readily apparent from the ensuing specification when taken in conjunction with the appended claims.

DESCRIPTION OF THE PREFERRED EMBODIMENTS

A recent development in tactical ordnance assures the reliable breaching of holes or safe lanes across mine and obstacle laden areas. The lightweight and uncomplicated line charge has explosive charges detonated via a fabric reinforced and explosively filled detonating cord. The resulting line charge design, designated the anti-personnel obstacle breaching system (APOBS, MK7 MOD 1), is relative low cost, simple, reliable, and useful for other weapon and non-weapon system applications. See the above cross-referenced patent applications for details of the line charge system.

The APOBS line charge is deployed by an interconnected rocket motor which pulls the line charge out of its container and across the obstacle laden area. After the line charge pays out completely from the container, a parachute, or drogue chute, that may be attached to the near end of the line charge, is pulled from the container, fills with air, and slows the outward travel of the line charge. The inertial drag created by the parachute straightens the length of the line charge to establish its effective length. In addition, since the container may remain attached to the near end of the line charge, the container creates an additional inertial drag that augments the drag created by the parachute. The combined drag credited to both the parachute and the container assures that the line charge is straightened out and that its travel down range is limited.

However, when the outward-bound line charge is fully extended, the container is often propelled forward with sufficient energy to cause the line charge to spring forward and loop past forward sections of the line charge. These phenomena are known as the "J" effect. The "J" effect is a consequence of the inertial forces attributed to the outward-bound line charge.

Figure 1:
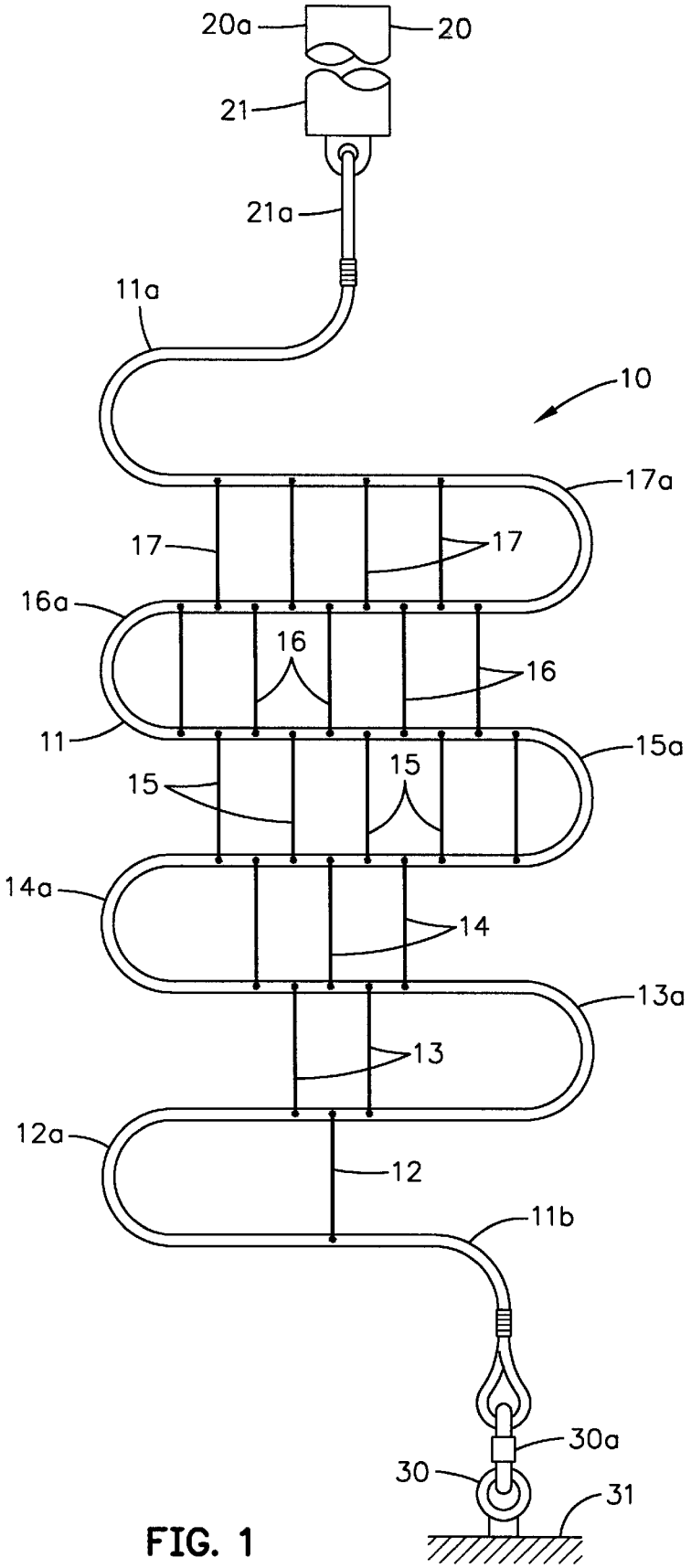
FIG. 1 is a schematic side view of one embodiment of the energy damper in accordance with this invention.

Referring to FIG. 1, the "J" effect is reduced by inclusion of damper system 10 of this invention which is a is combination energy damper and recoil limiter. Damper system 10 has an elongate strength member 11 connected in line with line charge 20 and pad eye 30. Eye 30 is secured to structure 31 the container for line charge 20 and/or parachute (drogue chute) that provides inertial drag to counteract the inertial energy of line charge 20 as it is deployed by the rocket. Strength member 11 of damper 10 is connected to fuze 21 at near end 20*a* of line charge 20 and to eye 30 which extends from parachute and/or container structure 31 for line charge 20. Rigging thimble 21*a* connects 22 far end 11*a* of strength member 11 to fuze 21 and threaded quick link 30*a* connects near end 11*b* of member 11 to eye 30 and structure 31.

Strength member 11 may be made from braided nylon that has a tensile strength of about 500 pounds, for example, and is arranged in a serpentine-shaped configuration. Varying numbers of nylon break lines make up sets of break lines 12, 13, 14, 15, 16, and 17 that are connected between successive turns 12*a*, 13*a*, 14*a*, 15*a*, 16*a*, and 17*a*. Break lines of sets 12, 13, 14, 15, 16, and 17 have their opposite ends secured to strength member 11 by sewing, bonding, stitching, etc. Sets of break lines 12, 13, 14, 15, 16, and 17 stretch and sustain different levels of tensile forces before they break. Set 17 is stronger than set 16; set 16 is stronger than set 15; set 15 is stronger than set 14; set 14 is stronger than set 13; and set 13 is stronger than set 12. Typically, break line set 12 may sustain a tensile load of 10 pounds before it breaks; break line set 13 might sustain a tensile load of 30 pounds before it fails; break line set 14 may sustain a tensile load of 50 pounds before it breaks; break line set 15 may sustain a tensile load of 100 pounds before it parts; break line set 16 might sustain a tensile load of 200 pounds before it fails; and break line set 17 might sustain a tensile load of 300 pounds before it parts. It is to be understood that these strengths are designated as exemplary and are not intended to be limiting.

In operation, when line charge 20 is deployed and the rocket motor pulls it from its storage container, structural member 11 of damper system 10 is put into tension due to the inertia of the outward bound line charge 20. As the tensile loads increase, the successive turns 12*a*, 13*a*, 14*a*, 15*a*, 16*a*, and 17*a* of nylon strength member 11 begin to move apart. This movement stretches each successive set of break lines 12, 13, 14, 15, 16, and 17 until each set snaps and releases energy. Sets of break lines 12, 13, 14, 15, 16, and 17 are designed to stretch and absorb increasing amounts of energy before they break and dissipate the increasing amounts of energy. In this manner the entire damper system 10 absorbs energy and releases it over time as break lines 12, 13, 14, 15, and 16 break and ultimately reduce the energy that would otherwise be available to pick up and sling the container forward. This effectively limits the "J" recoil potential to virtually neutralize this source of the "J" effect.

Figure 2:
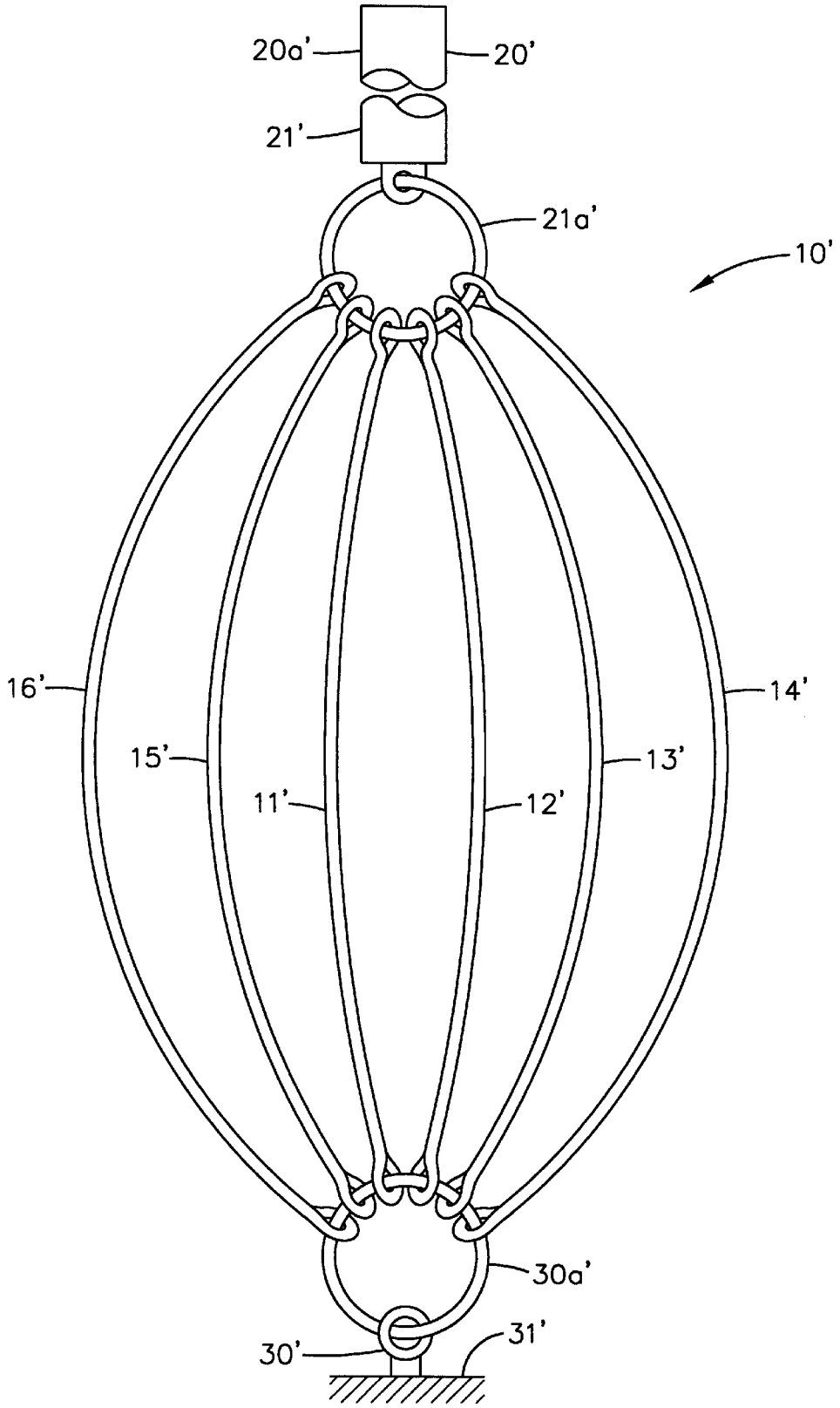
FIG. 2 is a schematic side view of another embodiment of the energy damper according to this invention.

Referring to FIG. 2, modified damper system 10' extends between an elongate strength member 16' connected in line with line charge 20' and pad eye 30'. Eye 30' may be coupled to a container 31' for line charge 20' and/or parachute (drogue chute) that provides inertial drag to counteract the inertial energy of line charge 20' as it is deployed by the rocket. Break lines 11', 12', 13', 14', and 15' and strength member 16' of damper system 10' are connected to fuze 21' at the near end 20*a'* of line charge 20' and to eye 30' which extends from a parachute and/or container structure 31' for line charge 20'. D-ring 21*a'* is interposed between fuze 21' and the far ends of break lines 11', 12', 13', 14', and 15' and strength member 16' to connect their far ends to fuze 21' and D-ring 30*a'* is interposed between eye 30' and break lines 11', 12', 13', 14', and 15' and strength member 16' to connect their near ends to eye 30' and structure 31'.

Damper system 10' has lengths of nylon break lines 11', 12', it 13', 14', and 15', and strength member 16' connected to "D" or "O" ring 30*a'* by thimbles at their near ends and "D" or "O" ring 21*a'* by thimbles at their far ends. Each length of nylon break lines 11', 12', 13', 14', and 15' is successively longer and proportionately stronger with larger diameters (more nylon fibers) to provide increased strengths.

Strength member 16' is longer than break lines 11', 12', 13', 14' and 15' and is the strongest, having a tensile strength of in the range of about 500 pounds, for example. Break lines 11', 12', 13', 14', and 15' bear different tensile loads before they break. Break line 15' is stronger than set 14'; break line 14' is stronger than break line 13'; break line 13' is stronger than break time 13'; break line 13' is stronger than break line 12'; and break line 12' is stronger than break line 11'. Typically, break line 11' might bear a tensile load of 50 pounds before it parts; break line 12' might bear a tensile load of 60 pounds before it fails; break line 13' may sustain a tensile load of 70 pounds before it parts; break line 14' might bear a tensile load of 80 pounds before it breaks; and break line 15' might hold a tensile load of 90 pounds before it fails. These representative loads are intended to be for the purposes of demonstration and are not limiting on this invention.

As line charge 20' is deployed and the rocket motor pulls it from its storage container, damper system 10' is put into tension due to the inertia of the outward bound line charge

20'. As the tensile loads increase, each of successively longer break lines 11', 12', 13', 14', and 15' stretches as it bears the increasing loads during deployment until it snaps and releases energy. Break lines 11', 12', 13', 14', and 15', thus absorb increasing amounts of energy before they break and dissipate the increasing amounts of energy. Thus, damper system 10' absorbs energy and releases it over time as break lines 11', 12', 13', 14', and 15' stretch and break to ultimately reduce the energy that would otherwise be available to pick up and sling the container forward. This effectively limits the "J"-shaped recoil potential and virtually neutralizes this source of the "J" effect.

The longest line joining line charge 10' to eye 30' is strength member 16'. Strength member 16' does not break because it is sufficiently strong to withstand the deployment forces.

In accordance with this invention damper systems 10 and 10' are used to limit the recoil associated with line charge launches to eliminate the "J" effect by dissipating launch energy and limiting line charge recoil to thereby increase the effective length of a line charge on deployment. In addition, damper systems 10 and 10' can be used in a series or in parallel with additional dampers or break lines to absorb energy and may make use of elastic fibrous materials other than nylon to absorb energy. Furthermore, damper systems 10 and 10' can be made as large as necessary to accommodate the volume of material needed for energy absorption depending on the size of the line charge and the excess energy imparted by rocket or mortar. The energy absorption and dissipation rate of damper systems 10 and 10' may vary by configuring the system with break lines of various strength, sizes, and material properties. The damper systems may have any given length or diameter and may be made from numerous materials other than nylon.

Accordingly, having this disclosure in mind, one skilled in the art to which this invention pertains will select and assemble various components with various assembly techniques from among a wide variety available in the art. For example, this invention could be adapted to applications other than the deployment of line charges. The invention could find application wherever an object or component is accelerated or displaced away from another body which serves as an inertial drag to prevent excessive acceleration or displacement of the component from the other body. Such an application could be where a lifeline or flexible hose is extended from one location to link it with another, or where a load is dropped from an aircraft, ship, etc. Therefore, this disclosure is not to be construed as limiting, but rather, is intended to be demonstrative of this inventive concept.

Other line charge systems may make use of damper systems 10 and 10' by placing them in series or parallel connection within a line charge system. Dampers 10 and 10' are scalar and may be made to contain various sizes of stretchable, and/or flowable materials for energy absorption. Numerous dampers may be located within a line charge (i.e. between charges) in any combination as required.

It should be readily understood that many modifications and variations of the present invention are possible within the purview of the claimed invention. It is to be understood that within the scope of the appended claims the invention may be practiced otherwise than as specifically described.

We claim:

1. An energy damper comprising:

a plurality of break lines having different tensile strengths to sequentially part as the tensile strengths of said break lines are exceeded to absorb and dissipate energy; and an elongate strength member to be connected between a component and a source of inertial drag, said break lines sequently parting to absorb and dissipate energy during displacement of said component from said source of inertial drag, said strength member being connected between said displaced component and said source of inertial drag to limit said displacement, said strength member having greater tensile strength than individual ones of said break lines and being arranged in a serpentine shape with said break lines connected in sets to said strength member, and different ones of said sets of break lines being each connected across separate turns in said serpentine-shaped strength member and having said different tensile strengths.

2. An energy damper according to claim 1 in which said component is a line charge being deployed and said source of inertial drag is a container for said line charge.

3. An energy damper according to claim 1 in which said component is a line charge being deployed and said source of inertial drag is a parachute for said line charge.

4. A damper system comprising:

means for providing an elongate strength member between a line charge and a source of inertial drag to limit displacement of said line charge; and means coupled between said line charge and said source of inertial drag for providing a plurality of break lines having different tensile strengths to sequentially part as the tensile strengths of said break lines are exceeded to absorb and dissipate energy during displacement of said line charge from said source of inertial drag.

5. A damper system according to claim 4 in which said elongate strength member providing means has greater tensile strength than individual ones of said break lines and is arranged in a serpentine shape with said break lines connected in sets to said elongate strength member providing means.

6. A damper system comprising:

means for providing an elongate strength member between a line charge and a source of inertial drag to limit displacement of said line charge; and means coupled between said line charge and said source of inertial drag for providing a plurality of break lines having different tensile strengths to sequentially part as the tensile strengths of said break lines are exceeded to absorb and dissipate energy during displacement of said line charge from said source of inertial drag, said elongate strength providing means having greater tensile strength than individual ones of said break lines and being arranged in a serpentine shape with said break lines being connected in sets to said elongate strength providing means, and different ones of said sets of break lines being connected across separate turns in said serpentine-shaped providing means and having said different tensile strengths.

7. A damper system according to claim 6 in which said source of inertial drag is a container for said line charge.

8. A damper system according to claim 6 in which said source of inertial drag is a parachute for said line charge.

* * * * *